US008129927B2

(12) United States Patent
Yamauchi et al.

(10) Patent No.: US 8,129,927 B2
(45) Date of Patent: Mar. 6, 2012

(54) DRIVING DEVICE AND DRIVING METHOD OF ELECTRIC DISCHARGE LAMP, LIGHT SOURCE DEVICE, AND IMAGE DISPLAY APPARATUS

(75) Inventors: Kentaro Yamauchi, Ashiya (JP); Tetsuo Terashima, Chino (JP)

(73) Assignee: Seiko Epson Corporation, Tokyo (JP)

( * ) Notice: Subject to any disclaimer, the term of this patent is extended or adjusted under 35 U.S.C. 154(b) by 444 days.

(21) Appl. No.: 12/534,500

(22) Filed: Aug. 3, 2009

(65) Prior Publication Data

US 2010/0033105 A1 Feb. 11, 2010

(30) Foreign Application Priority Data

Aug. 7, 2008 (JP) ..... 2008-204637

(51) Int. Cl.
*H05B 41/36* (2006.01)

(52) U.S. Cl. ..... 315/308; 315/291

(58) Field of Classification Search ..... 315/287, 315/291, 302, 307, 308, 309
See application file for complete search history.

(56) References Cited

U.S. PATENT DOCUMENTS 6,232,725 B1 5/2001 Derra et al.
6,498,439 B2 * 12/2002 Van Den Nieuwenhuizen et al. ..... 315/290
6,552,499 B2 * 4/2003 Derra et al. ..... 315/291
6,815,907 B2 11/2004 Riederer
2010/0066262 A1 * 3/2010 Van Den Berg ..... 315/287
2010/0244744 A1 * 9/2010 Pollmann-Retsch ..... 315/307
2010/0320938 A1 * 12/2010 Pollmann-Retsch et al. . 315/307

FOREIGN PATENT DOCUMENTS

JP A-2004-525496 8/2004
WO WO 02/091806 A1 11/2002
WO WO 2008/053428 A1 5/2008

OTHER PUBLICATIONS

European Search Report issued in European Patent Application No. 09166333.6; Mar. 2, 2010.

* cited by examiner

*Primary Examiner* — Don Le
(74) *Attorney, Agent, or Firm* — Oliff & Berridge, PLC

(57) ABSTRACT

A driving device of an electric discharge lamp includes: a discharge lamp lighting unit which supplies power to the electric discharge lamp while alternately switching polarity of voltage applied between two electrodes of the electric discharge lamp to lighting the electric discharge lamp; and an anode duty ratio modulating unit which sets at least a first retention period and a second retention period having an anode duty ratio different from that of the first retention period and provided after the first retention period to modulate the anode duty ratios, assuming that each of the retention periods is a period for retaining an anode duty ratio as ratio of an anode period in which one of the electrodes operates as anode at a constant value in one cycle of the polarity switching, wherein the anode duty ratio modulating unit has a first modulation mode for operating the electric discharge lamp in steady condition and a second modulation mode for providing larger change of the anode duty ratio between the first retention period and the second retention period than change of the first modulation mode.

20 Claims, 13 Drawing Sheets

DUTY RATIO: NOT MODULATED

DUTY RATIO: MODULATED

INITIAL PERIOD FROM START OF USE

ELECTRODE DETERIORATION

AFTER GROWTH OF PROJECTION

DRIVING DEVICE AND DRIVING METHOD OF ELECTRIC DISCHARGE LAMP, LIGHT SOURCE DEVICE, AND IMAGE DISPLAY APPARATUS

This application claims priority to Japanese Application No. 2008-204637 filed in Japan on Aug. 7, 2008, the disclosure of which is hereby incorporated by reference in its entirety.

BACKGROUND

1. Technical Field

The present invention relates to a technology for driving an electric discharge lamp which emits light by discharge generated between electrodes.

2. Related Art

A high intensity discharge lamp such as high-pressure gas discharge lamp is used as a light source of an image display apparatus such as projector. For lighting the high intensity discharge lamp, alternating current (AC ramp current) is supplied to the high intensity discharge lamp. As a method for lighting the high intensity discharge lamp by the supply of AC ramp current, such a technology has been proposed which uses AC ramp current having an approximately constant absolute value and modulated pulse width ratio of positive and negative pulse widths to be supplied to the high intensity discharge lamp so as to increase stability of light arc generated within the high intensity discharge lamp (for example, see JP-T-2004-525496).

When the high intensity discharge lamp is lighted with AC ramp current having modulated pulse width, the period for use of the high intensity discharge lamp is limited due to deterioration of electrodes or deposition (blacking) of electrode material on the interior of the high intensity discharge lamp. This problem arises not only from the high intensity discharge lamp but also from various types of discharge lamp (electric discharge lamp) which emit light by arc discharge between electrodes.

SUMMARY

It is an advantage of some aspects of the invention to provide a technology for increasing use period of an electric discharge lamp.

The invention can be embodied as the following aspects or embodiments.

An aspect of the invention is directed to a driving device of an electric discharge lamp including: a discharge lamp lighting unit which supplies power to the electric discharge lamp while alternately switching polarity of voltage applied between two electrodes of the electric discharge lamp to light the electric discharge lamp; and an anode duty ratio modulating unit which sets at least a first retention period and a second retention period having an anode duty ratio different from that of the first retention period and provided after the first retention period to modulate the anode duty ratios, assuming that each of the retention periods is a period for retaining an anode duty ratio as ratio of an anode period in which one of the electrodes operates as anode at a constant value in one cycle of the polarity switching. The anode duty ratio modulating unit has a first modulation mode for operating the electric discharge lamp in steady condition and a second modulation mode for providing larger change of the anode duty ratio between the first retention period and the second retention period than change of the first modulation mode.

Projections formed at the electrode tips of the electric discharge lamp grow toward the opposed electrodes with increase in change of the anode duty ratio. Also, deposition (blacking) of electrode material on the inner wall of the electric discharge lamp proceeds with increase in change of the anode duty ratio. In this case, the amount of light emission from the electric discharge lamp may decrease. According to this aspect, promotion of projection growth and restoration of the deteriorated electrodes can be achieved by providing larger change of the anode duty ratio between the continuous two retention periods in the second mode than the corresponding change in the first modulation mode for steady operation. During steady operation, blacking of the electric discharge lamp can be prevented by reducing the change. Thus, the electric discharge lamp can be used for a long period.

An aspect of the invention is directed to the driving device of an electric discharge lamp, wherein the anode duty ratio in the first retention period and the anode duty ratio in the second retention period vary in such a manner as to cross a duty ratio reference value established in advance based on an intermediate value in the modulation range of the anode duty ratios in the second modulation mode.

According to this aspect, the two electrodes can be restored in a balanced manner with sufficient change of the anode duty ratios provided.

An aspect of the invention is directed to the driving device of an electric discharge lamp, wherein the length of the first retention period and the length of the second retention period are different from each other.

Generally, when an electrode has high temperature under the condition that the anode duty ratio is high, sputter of electrode material increases during the period in which the corresponding electrode is operating as cathode. That is, when the electrode has high temperature immediately after inversion of the polarity from anode to cathode under the condition that the anode duty ratio is high, electrode material is easily separated. According to this aspect, the first retention period and the second retention period having considerably different anode duty ratios are set at different lengths. In this case, the period in which the corresponding electrode is operating as cathode can be shortened under the condition of high anode duty ratio and high temperature of the electrode. Thus, reduction of sputter and further prevention of blacking can be achieved. Accordingly, the electric discharge lamp can be used for a longer period.

An aspect of the invention is directed to the driving device of an electric discharge lamp, wherein the length of the period in which the anode duty ratio is higher than the duty ratio reference value is longer than the length of the period in which the anode duty period is lower than the duty ratio reference value in a predetermined period of one cycle of the modulation. The length of the period in which the anode duty ratio is higher than the duty ratio reference value is shorter than the length of the period in which the anode duty period is lower than the duty ratio reference value in the remaining period of one cycle of the modulation.

According to this aspect, the temperature of one electrode is raised higher to further promote growth of projections and prevent sputter from the one electrode in the predetermined period. Also, the temperature of the other electrode is raised higher to further promote growth of projections and prevent sputter from the other electrode in the remaining period. Thus, promotion of growth of projections and prevention of sputter can be achieved for both of the electrodes. Accordingly, the electric discharge lamp can be used for a long period.

An aspect of the invention is directed to the driving device of an electric discharge lamp, wherein the driving device of the electric discharge lamp further includes an electrode condition detecting unit which detects deterioration of the electrodes by use of the electric discharge lamp. The anode duty ratio modulating unit performs the second modulation mode when the electrode condition detecting unit detects deterioration of the electrodes.

According to this aspect, change of the anode duty ratio is increased based on deterioration of the electrodes. Thus, formation of projection is promoted for the electrode having deterioration, and blacking is prevented for the electrode having no deterioration. Accordingly, the electric discharge lamp can be used for a long period.

An aspect of the invention is directed to the driving device of an electric discharge lamp, wherein the electrode condition detecting unit detects the deterioration condition based on voltage generated between the electrodes when predetermined power is supplied to the electric discharge lamp. The anode duty ratio modulating unit judges that the electrodes are deteriorated when the voltage between the electrodes is equal to or higher than reference voltage.

Generally, the length of arc increases as an electrode deteriorates, and thus voltage applied at the time of predetermined power supply rises. According to this aspect, therefore, deterioration of the electrodes can be more easily detected.

An aspect of the invention is directed to the driving device of an electric discharge lamp, wherein the electric discharge lamp satisfies such condition that the temperature of one of the two electrodes is higher than the temperature of the other electrode during operation. The anode duty ratio modulating unit sets the maximum of the anode duty ratio of the one electrode in the modulation range at a value lower than the maximum of the anode duty ratio of the other electrode in the modulation range.

According to this aspect, the maximum of the anode duty ratio of one electrode having high temperature during operation is set at a value lower than the maximum of the anode duty ratio of the other electrode. Thus, excessive temperature increase of the electrode having high temperature during operation is prevented. As a result, deterioration of the corresponding electrode can be avoided.

An aspect of the invention is directed to the driving device of an electric discharge lamp, wherein the temperature of the one electrode increases higher than the temperature of the other electrode during operation by function of a reflection mirror provided on the electric discharge lamp for reflecting light emitted between the electrodes toward the other electrode.

Heat release from an electrode can be prevented by equipping a reflection mirror on the side of the corresponding electrode. According to this aspect, excessive temperature increase of the electrode disposed on the side of the reflection mirror for preventing heat release is avoided. Thus, deterioration of the electrode disposed on the side of the reflection mirror can be prevented.

An aspect of the invention is directed to the driving device of an electric discharge lamp, wherein, when the anode duty ratio of one of the two electrodes is at least equal to or higher than predetermined reference value, the discharge lamp lighting unit sets current level to be supplied to the two electrodes at the last end of the anode period during which the corresponding one electrode continuously operates as anode at a value higher than the average of current to be supplied during the anode period at the time of the power supply.

According to this aspect, the current level at the last end of the anode period in which the one electrode having high anode duty ratio continuously operates as anode is set at a value higher than the average of current during the anode period. Thus, the temperature of the electrode having high anode duty ratio can be further raised, and growth of the projections can be further promoted.

The invention can be embodied in various forms such as a driving device and a driving method of an electric discharge lamp, a light source device including an electric discharge lamp and a control method of the light source device, and an image display apparatus including the light source device.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
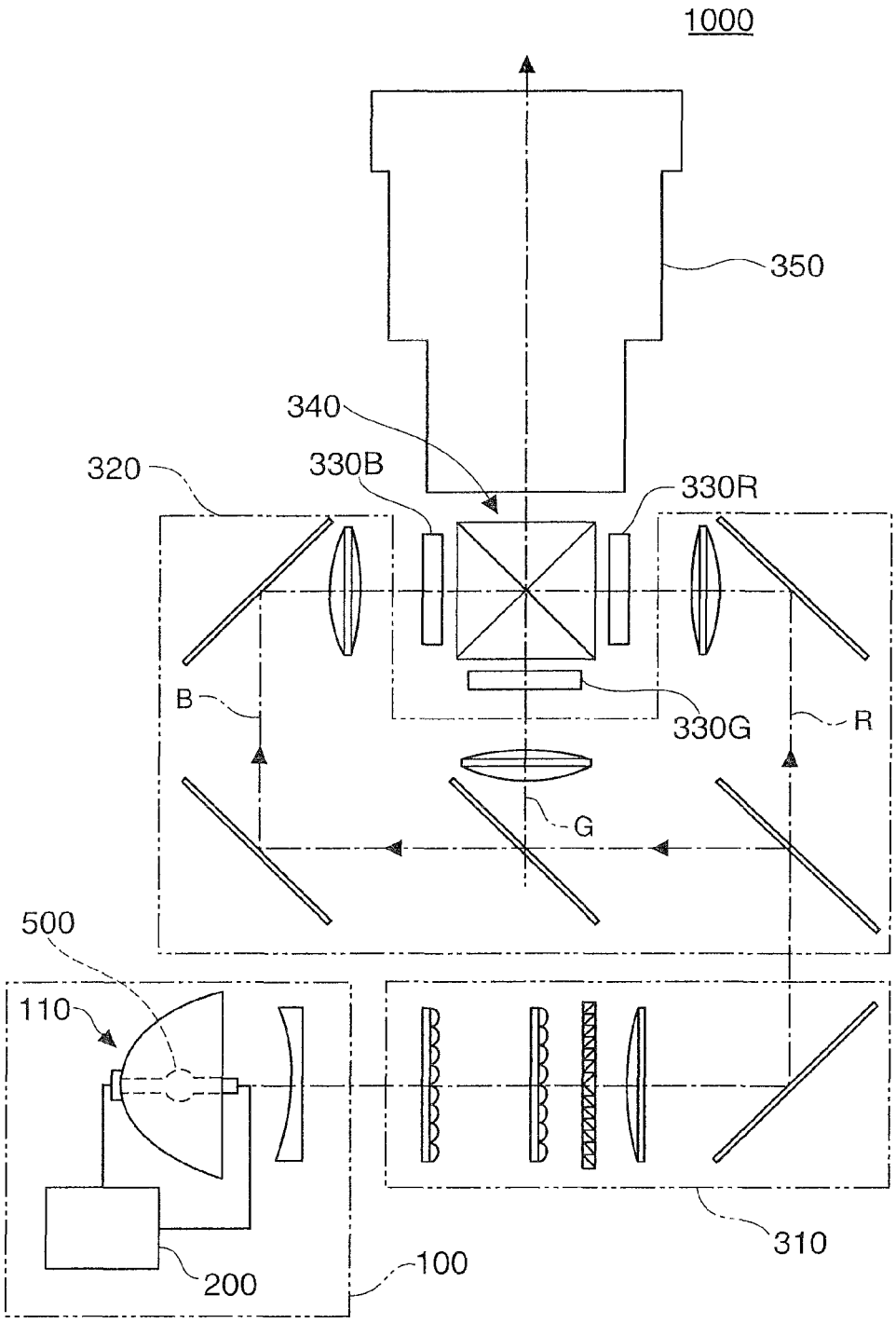
FIG. 1 schematically illustrates a structure of a projector according to a first embodiment of the invention.

FIG. 1 schematically illustrates a structure of a projector 1000 according to a first embodiment of the invention. The projector 1000 includes a light source device 100, an illumination system 310, a color separation system 320, three liquid crystal light valves 330R, 330G, and 330B, a cross dichroic prism 340, and a projection system 350.

The light source device 100 has a light source unit 110 including an electric discharge lamp 500, and a discharge lamp driving device 200 for driving the electric discharge lamp 500. The electric discharge lamp 500 discharges by receiving supply of electric power from the discharge lamp driving device 200. The light source unit 110 supplies lights emitted from the electric discharge lamp 500 toward the illumination system 310. The specific structures and functions of the light source unit 110 and the discharge lamp driving device 200 will be described later.

The illuminances of the lights emitted from the light source unit 110 are equalized, and simultaneously the polarization directions of the lights are converted into one direction by the illumination system 310. The lights having uniform illuminance and equalized polarization direction after passing through the illumination system 310 are divided into three color lights in red (R), green (G), and blue (B) by the color separation system 320. The three color lights divided by the color separation system 320 are modulated by the corresponding liquid crystal light valves 330R, 330G, and 330B. The three color lights modulated by the liquid crystal light valves 330R, 330G, and 330B are combined by the cross dichroic prism 340, and enter the projection system 350. The projection system 350 projects the received light on a not-shown screen to display an image as a full-color image produced by combining images modulated by the liquid crystal light valves 330R, 330G, and 330B. While the three color lights are separately modulated by the three liquid crystal light valves 330R, 330G, and 330B, these color lights may be modulated by one liquid crystal light valve having color filter. In this case, the color separation system 320 and the cross dichroic prism 340 can be eliminated.

Figure 2:
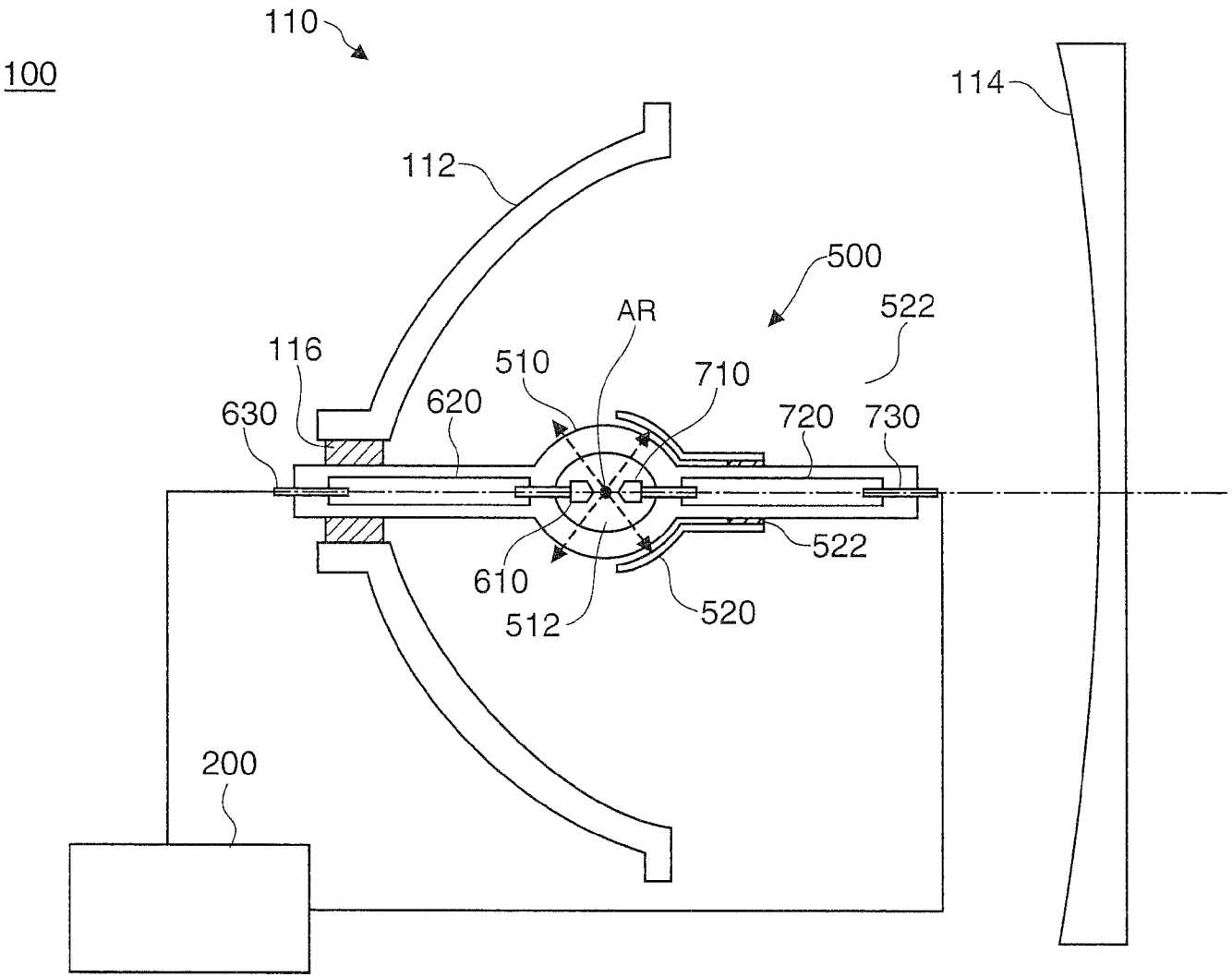
FIG. 2 illustrates a structure of a light source device.

FIG. 2 illustrates the structure of the light source device 100. As discussed above, the light source device 100 includes the light source unit 110 and the discharge lamp driving device 200. The light source unit 110 has the electric discharge lamp 500, a main reflection mirror 112 having spheroid reflection surface, and a collimating lens 114 for converting emission lights into approximately parallel lights. The reflection surface of the main reflection mirror 112 is not required to have spheroid shape. For example, the reflection surface of the main reflection mirror 112 may have paraboloid shape. In this case, the collimating lens 114 can be eliminated when the light emission portion of the electric discharge lamp 500 is disposed at the focus of the parabolic mirror. The main reflection mirror 112 and the electric discharge lamp 500 are bonded by inorganic adhesive 116.

The electric discharge lamp 500 has a discharge lamp main body 510 and a sub reflection mirror 520 having a spherical reflection surface bonded by inorganic adhesive 522. The discharge lamp main body 510 is made of glass material such as quartz glass. Two electrodes 610 and 710 made of metal having high melting point such as tungsten as electrode material, two connecting members 620 and 720, and two electrode terminals 630 and 730 are provided on the discharge lamp main body 510. The electrodes 610 and 710 are disposed such that the tips of the electrodes 610 and 710 are opposed to each other in a discharge space 512 formed at the center of the discharge lamp main body 510. Gas as discharge medium containing rare gas, mercury, metal halogen compound and the like is sealed into the discharge space 512. The connecting members 620 and 720 are components for electrically connecting the electrodes 610 and 710 and the electrode terminals 630 and 730.

The electrode terminals 630 and 730 are connected with output terminals of the discharge lamp driving device 200. The discharge lamp driving device 200 is connected with the electrode terminals 630 and 730 to supply pulsed alternating current (AC pulse current) to the electric discharge lamp 500. When the electric discharge lamp 500 receives AC pulse current, arc AR is generated between the tips of the two electrodes 610 and 710 within the discharge space 512. The arc AR releases light from the generation position of the arc AR in all directions. The light emitted toward the electrode 710 is reflected toward the main reflection mirror 112 by the sub reflection mirror 520. By reflection toward the main reflection mirror 112, the light emitted toward the electrode 710 can be effectively used. Hereinafter, the electrode 710 located close to the sub reflection mirror 520 is referred to as "sub mirror side electrode 710", and the other electrode 610 is referred to as "main mirror side electrode 610" as well.

Figure 3:
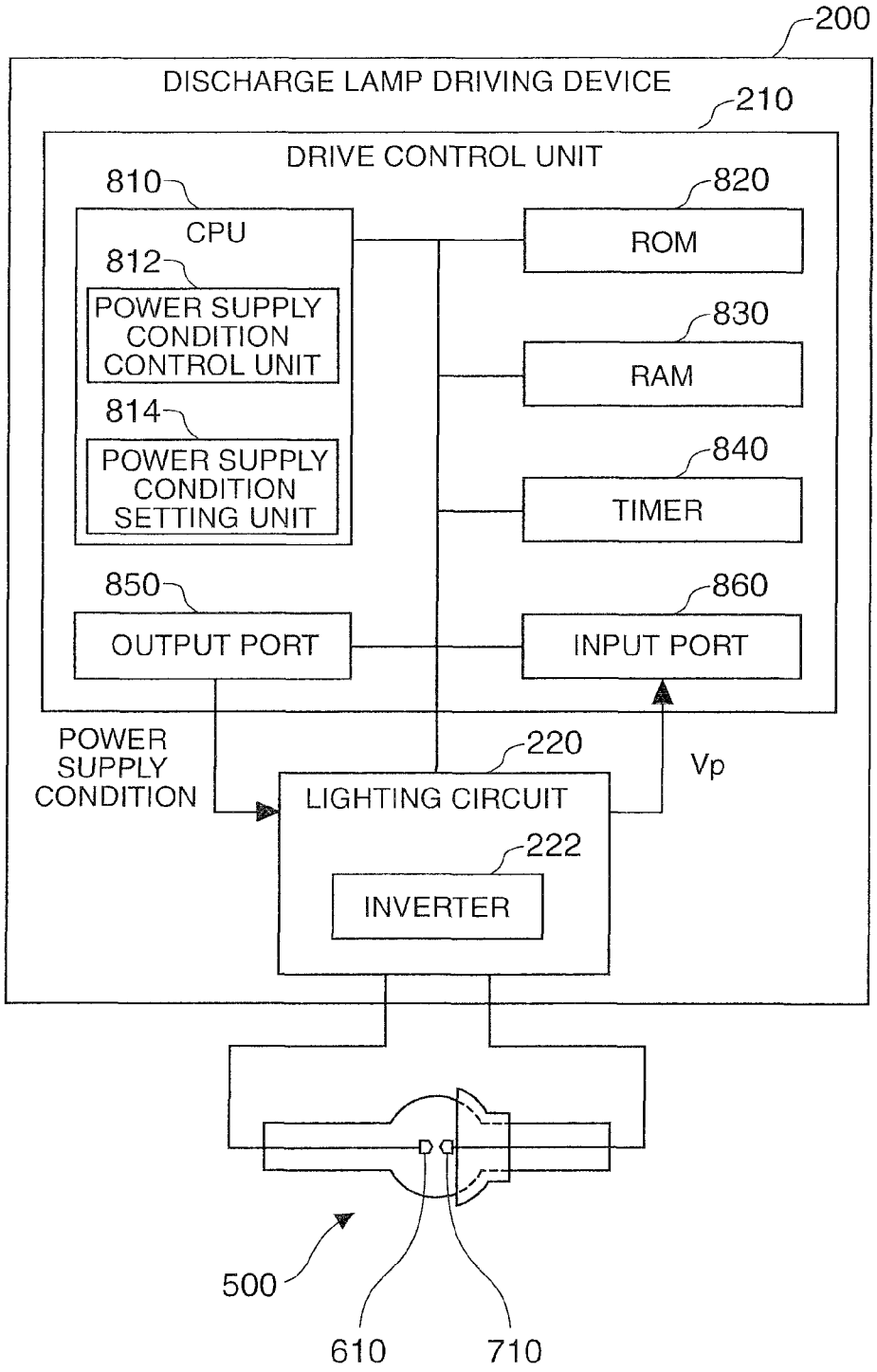
FIG. 3 is a block diagram showing a structure of a discharge lamp driving device.

FIG. 3 is a block diagram showing the structure of the discharge lamp driving device 200. The discharge lamp driving device 200 has a drive control unit 210 and a lighting circuit 220. The drive control unit 210 is a computer having a CPU 810, a ROM 820, a RAM 830, a timer 840, an output port 850 for outputting control signals to the lighting circuit 220, and an input port 860 for obtaining signals from the lighting circuit 220. The CPU 810 of the drive control unit 210 operates under programs stored in the ROM 820 in response to outputs from the timer 840. By this method, the CPU 810 provides the functions of a power supply condition control unit 812 and a power supply condition setting unit 814.

The lighting circuit 220 has an inverter 222 for generating AC pulse current. The lighting circuit 220 supplies AC pulse current having constant power (such as 200 W) to the electric discharge lamp 500 by controlling the inverter 222 according to control signals received from the drive control unit 210 via the output port 850. More specifically, the lighting circuit 220 generates AC pulse current according to the power supply condition (such as frequency of AC pulse current, duty ratio, and current waveform) specified by the control signals by controlling the inverter 222. The lighting circuit 220 supplies the AC pulse current generated by the inverter 222 to the electric discharge lamp 500.

The lighting circuit 220 detects voltage between the electrodes 610 and 710 (ramp voltage Vp) during supply of AC pulse current to the electric discharge lamp 500. The ramp voltage Vp detected by the lighting circuit 220 is inputted to the CPU 810 of the drive control unit 210 via the input port 860.

The power supply condition control unit 812 of the drive control unit 210 modulates duty ratio of AC pulse current. By modulating duty ratio of AC pulse current, the shapes of the electrode tips can be maintained in a preferable condition. Also, abnormal discharge caused by growth of needle crystals of the electrode material on the electrode surface can be prevented.

Figure 4A:
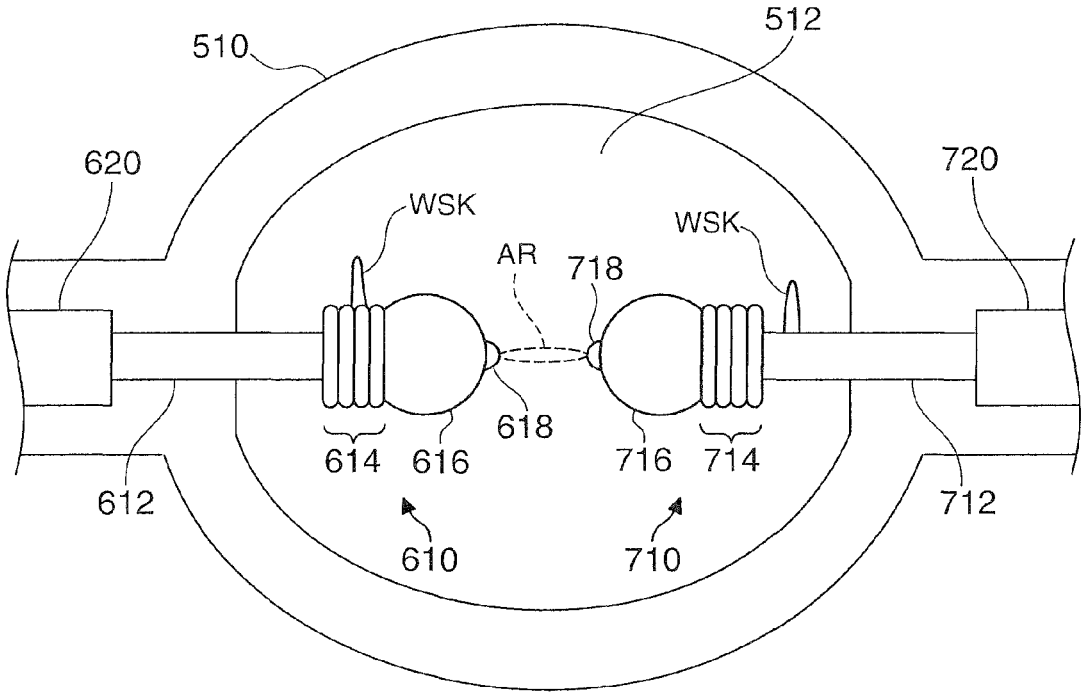
FIGS. 4A and 4B show effect of duty ratio modulation on electrodes.
Figure 4B:
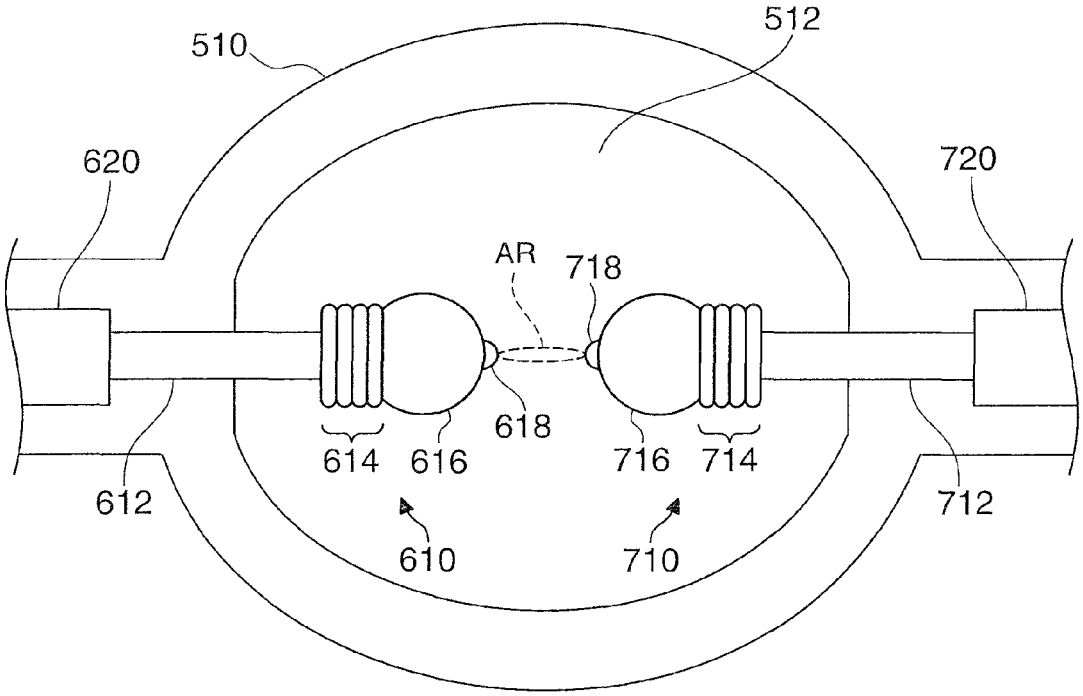

FIGS. 4A and 4B schematically illustrate effect of duty ratio modulation on the electrodes 610 and 710. FIG. 4A shows the central portion of the electric discharge lamp 500 operated without modulation of the duty ratio, and FIG. 4B shows the central portion of the electric discharge lamp 500 operated by modulated duty ratio.

As illustrated in FIGS. 4A and 4B, the electrode 610 has a spindle 612, a coil portion 614, a main body 616, and a projection 618. The electrode 610 is produced by winding wire of electrode material (such as tungsten) around the spindle 612 to form the coil portion 614, and heating and fusing the coil portion 614 thus formed. By this method, the main body 616 having large heat capacity and the projection 618 as the generation position of the arc AR can be produced at the tip of the electrode 610. The sub mirror side electrode 710 is produced in the same manner as that of the main mirror side electrode 610.

When the electric discharge lamp 500 is lighted, the gas sealed into the discharge space 512 is heated by generation of the arc AR and flows by convection within the discharge space 512. When the duty ratio of the AC pulse current is not modulated, the temperature distributions of the electrodes 610 and 710 come to steady condition. Since the temperature distributions of the electrodes 610 and 710 are under steady condition, the convection of the gas also comes to steady condition. The gas flowing within the discharge space 512 contains electrode material fused and evaporated by the arc AR. Thus, under the condition of steady convection, electrode material is locally accumulated on the spindles 612 and 712 and the coil portions 614 and 714 having low temperatures, and needle crystals WSK of electrode material grow as illustrated in FIG. 4A.

When the temperatures of the main bodies 616 and 716 and the projections 618 and 718 are not sufficiently high at the time of operation start of the lamp or for other reason, arc is generated from the needle crystals WSK toward the inner wall of the discharge space 512 in some cases due to growth of the needle crystals WSK. The arc generated from the needle crystals WSK toward the inner wall of the discharge space 512 causes deterioration of the inner wall, or abnormal condition in the halogen cycle for reproducing electrode material from the halogen compound as electrode material on the main bodies 616 and 716 or the projections 618 and 718 having high temperatures.

As discussed above, the needle crystals WSK grow when the duty ratio of the AC pulse current is not modulated. In this case, deterioration of the inner wall or abnormal condition in the halogen cycle is caused, and thus the life of the electric discharge lamp may be shortened. When the duty ratio of the AC pulse current is modulated, the temperature distributions of the electrodes 610 and 710 vary with time. In this case, generation of steady convection within the discharge space 512 is prevented, and local accumulation of electrode material and growth of the needle crystals caused thereby are reduced.

The power supply condition setting unit 814 according to the first embodiment sets modulation pattern (modulation mode) for modulating the AC pulse current by using the power supply condition control unit 812 based on predetermined parameters indicating the conditions of the electrodes 610 and 710. When the AC pulse current is modulated by the power supply condition control unit 812, anode duty ratio (described later) is modulated accordingly. Thus, the power supply condition setting unit 814 and the power supply condition control unit 812 can be collectively referred to as anode duty ratio modulating unit.

Figure 5A:
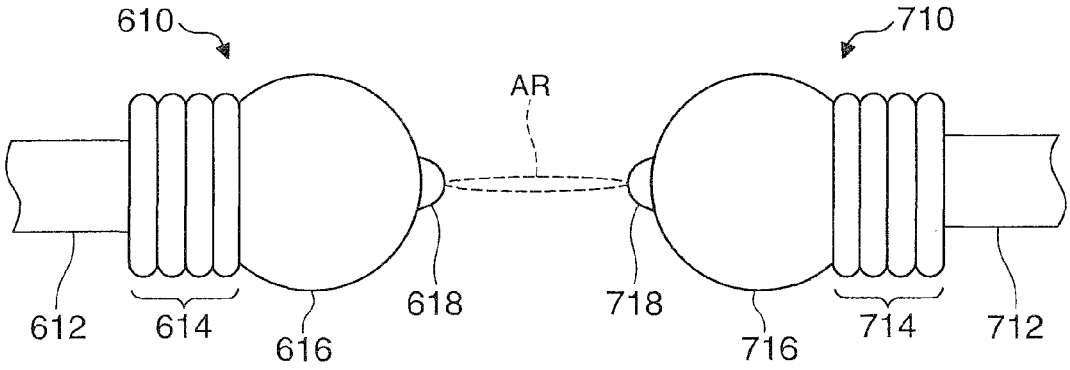
FIGS. 5A through 5C show changes of electrode shape by use of an electric discharge lamp.
Figure 5B:
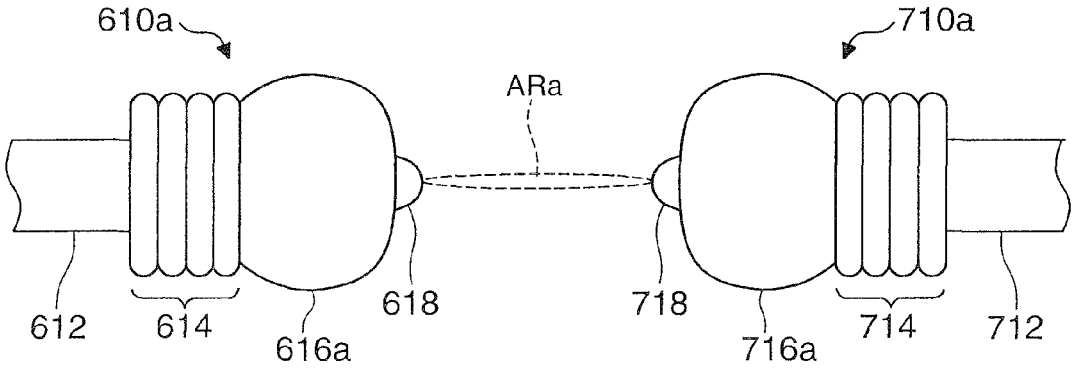
Figure 5C:
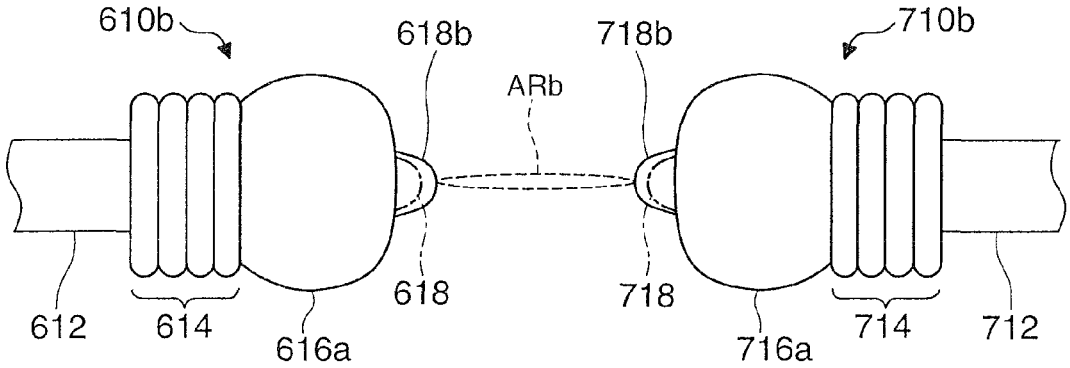

FIGS. 5A through 5C illustrate shape changes of the electrodes 610 and 710 by use of the electric discharge lamp 500. FIG. 5A shows the tips of the electrodes 610 and 710 in the period of initial use of the electric discharge lamp 500. FIG. 5B shows the tips of electrodes 610*a* and 710*a* deteriorated by use of the electric discharge lamp 500. FIG. 5C shows the tips of electrodes 610*b* and 710*b* after operating the electrodes 610*a* and 710*a* in the condition shown in FIG. 5B by using specific modulation pattern (described later). Since the main mirror side electrode 610 (610*a*, 610*b*) and the sub mirror side electrode 710 (710*a*, 710*b*) are similar in FIGS. 5A through 5C, the explanation of the sub mirror side electrode 710 (710*a*, 170*b*) is not repeated.

When the electric discharge lamp 500 is used, electrode material is evaporated from the tip of the electrode 610. As a result, the tip portion of a main body 616*a* becomes flat as shown in FIG. 5B. By flatness of the tip portion of the main body 616*a*, the position of the projection 618 shifts toward the spindle 612, and the length of an arc ARa generated by discharge increases. With increase of the length of the arc ARa, voltage between electrodes required for supplying the same electric power, i.e., the ramp voltage Vp rises. Thus, the ramp voltage Vp gradually increases with deterioration of the electric discharge lamp 500. According to the first embodiment, therefore, the ramp voltage Vp is used as a parameter indicating deterioration of the electric discharge lamp 500.

When AC pulse current modulated using the specific modulation pattern is supplied between the electrodes 610 and 710 under the condition shown in FIG. 5B, the projection 618 grows toward the opposed electrode. By the growth of a projection 618*b* as illustrated in FIG. 5C, the length of an arc ARb decreases, and the ramp voltage Vp lowers. Thus, the electric discharge lamp 500 can be used for a longer period by reduction of the ramp voltage Vp. However, when this modulation pattern for promoting growth of the projections 618 and 718 is used, blacking of the inner wall of the discharge space 512 or other problem may be caused.

For avoiding this problem, the power supply condition setting unit 814 in the first embodiment sets the duty ratio modulation pattern for the AC pulse current at a first modulation pattern for preventing blacking of the inner wall of the discharge space 512 when the ramp voltage Vp is lower than predetermined threshold voltage Vt (such as 90V). When the ramp voltage Vp is equal to or higher than the predetermined threshold voltage Vt, the power supply condition setting unit 814 sets the duty ratio modulation pattern for the AC pulse current at a second modulation pattern for promoting growth of the projections 618 and 718. Thus, the power supply condition setting unit 814 having the function for switching the modulation patterns (modulation conditions) can be referred to as modulation condition switching unit.

While the modulation patterns are switched based on whether the ramp voltage Vp is equal to or higher than the predetermined voltage Vt according to the first embodiment, it is possible to set a threshold voltage Vu during increase of the ramp voltage Vp and a threshold voltage Vd during decrease of the ramp voltage Vp at different voltages. In this case, it is preferable to set the threshold voltage Vu during increase at a higher voltage than the threshold voltage Vd during decrease for the reason that the period for using the first modulation pattern for preventing blacking of the inner wall can be increased after sufficient growth of the projections.

Figure 6:
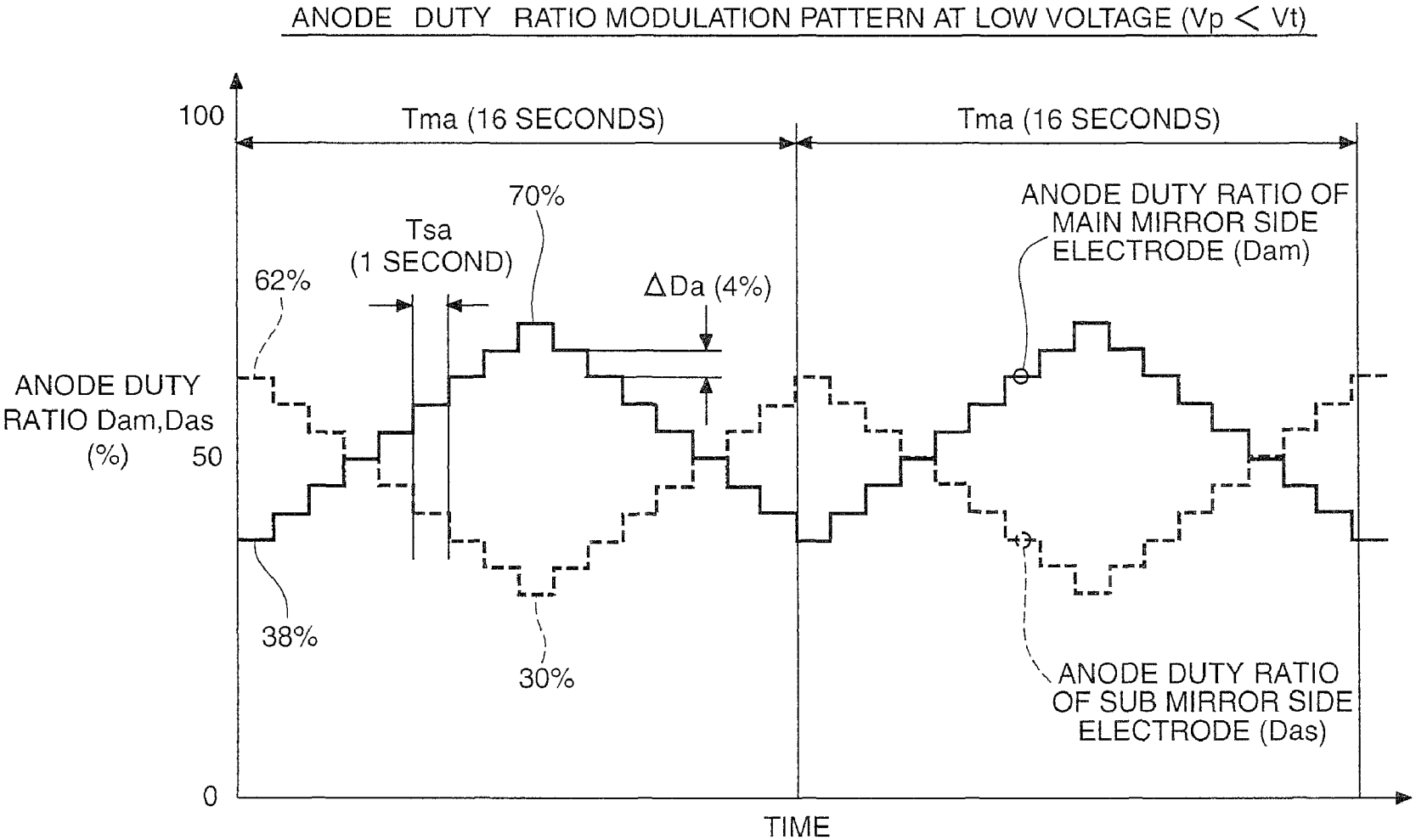
FIG. 6 shows a first modulation pattern of duty ratios at low voltage.

FIG. 6 shows the modulation pattern (first modulation pattern) when the ramp voltage Vp is lower than the threshold voltage Vt (at low voltage). The graph in FIG. 6 shows changes of anode duty ratios Dam and Das with time. The anode duty ratios Dam and Das herein are ratios of period (anode period) in which each of the two electrodes 610 and 710 operates as anode for one cycle of AC pulse current. A solid line in the graph in FIG. 6 indicates the anode duty ratio Dam of the main mirror side electrode 610, and a broken line indicates the anode duty ratio Das of the sub mirror side electrode 710.

In the first modulation pattern, the anode duty ratios Dam and Das are changed by a predetermined change ΔDa (4%) every time a step time Tsa (1 second) as 1/16 of a modulation cycle Tma (16 seconds) elapses. According to the first embodiment, the modulation cycle Tma in the first modulation pattern is 16 seconds, and the step time Tsa is 1 second. However, the modulation cycle Tma and the step time Tsa can be varied according to the characteristics and power supply condition of the electric discharge lamp 500.

As can be seen from FIG. 6, according to the first modulation pattern, the maximum of the anode duty ratio Dam of the main mirror side electrode 610 is higher than the maximum of the anode duty ratio Das of the sub mirror side electrode 710. However, the maximum duty ratios of the two electrodes 610 and 710 are not required to be different. When the maximum values of the anode duty ratios are high, the highest temperatures of the electrodes 610 and 710 increase. When the electric discharge lamp 500 having the sub reflection mirror 520 is used as illustrated in FIG. 2, heat from the sub mirror side electrode 710 is not easily released. Thus, it is preferable to set the maximum of the anode duty ratio Das of the sub mirror side electrode 710 at a value lower than the maximum of the anode duty ratio Dam of the main mirror side electrode 610 for the reason that excessive temperature increase of the sub mirror side electrode 710 can be prevented. When the temperature of one electrode is higher than that of the other electrode due to effect of cooling method or the like at the time of operation of the two electrodes 610 and 710 under the same operation condition, it is generally preferable that the anode duty ratio of the one electrode is lower than the anode duty ratio of the other electrode.

Figure 7A:
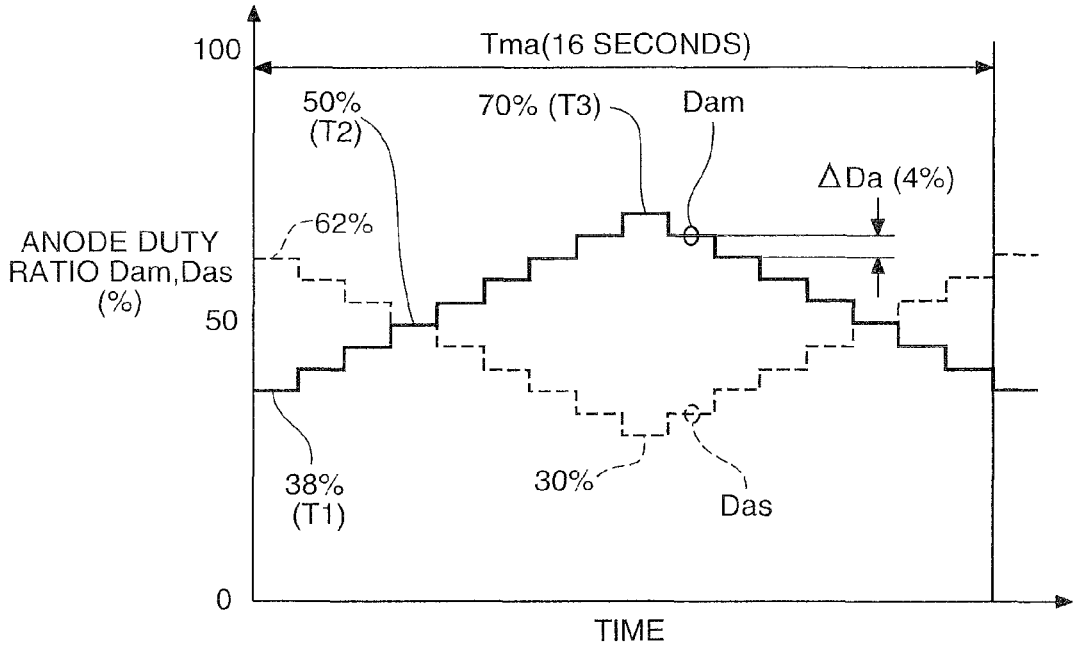
FIGS. 7A and 7B show operation of the electric discharge lamp with modulated anode duty ratios in the first modulation pattern.
Figure 7B:
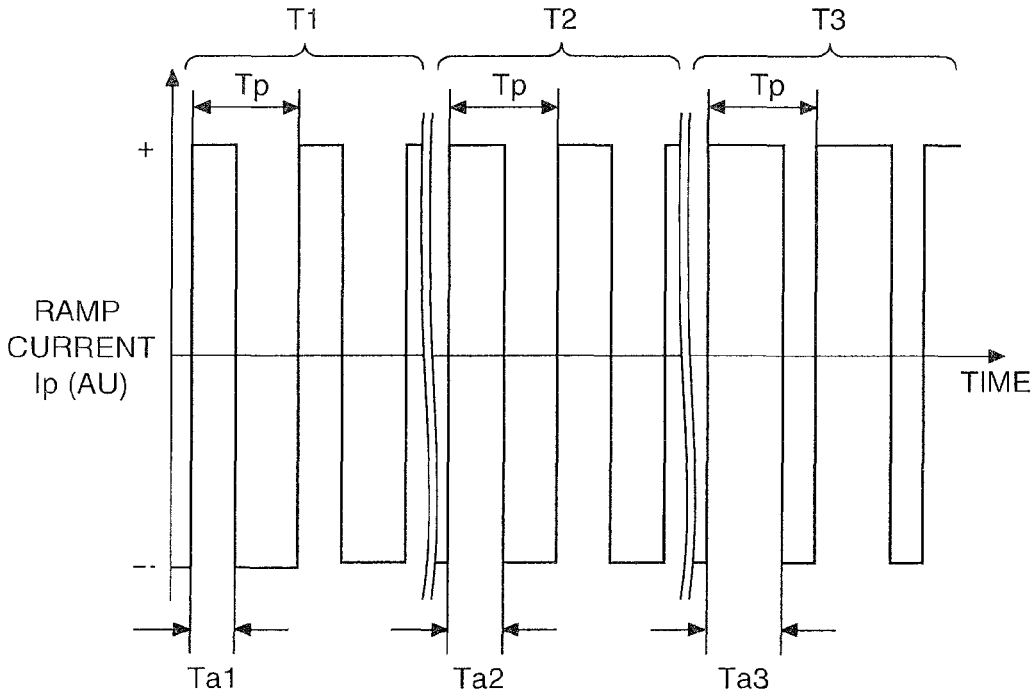

FIGS. 7A and 7B show the operation of the electric discharge lamp 500 with modulated anode duty ratios according to the first modulation pattern. FIG. 7A is different from FIG. 6 in that changes of the anode duty ratios Dam and Das with time are shown only for one modulation cycle (1 Tma). Other points in FIG. 7A are approximately similar to those in FIG. 6, and the same explanation is not repeated herein. FIG. 7B is a graph showing changes of ramp current Ip (discharge current) with time for each of three periods T1 through T3 in which the anode duty ratio Dam of the main mirror side electrode 610 is set at different values (38%, 50%, and 70%). In FIG. 7B, the positive direction of the ramp current Ip corresponds to the direction where current flows from the main mirror side electrode 610 toward the sub mirror side electrode 710. That is, the main mirror side electrode 610 operates as anode during periods Ta1 through Ta3 in which the ramp current Ip is positive, and the main mirror side electrode 610 operates as cathode during the remaining periods in which the ramp current Ip is negative.

As can be seen from FIG. 7B, a switching cycle Tp for switching the polarity of the main mirror side electrode 610 is constant for each of the three periods T1 through T3 having the different anode duty ratios Dam. Thus, the frequency of the AC pulse current (fd=1/Tp) becomes a constant frequency (such as 80 Hz) for the entire periods of a modulation cycle Tma. On the other hand, the anode periods Ta1 through Ta3 of the main mirror side electrode 610 are set at different lengths for each of the periods T1 through T3 in which the anode duty ratios Dam are different. According to the first embodiment, therefore, the anode duty ratio Dam is modulated by changing the anode period Ta while a frequency fd of AC pulse current (hereinafter referred to as "driving frequency fd" as well) is kept constant. The driving frequency fd is not required to be constant.

Figure 8:
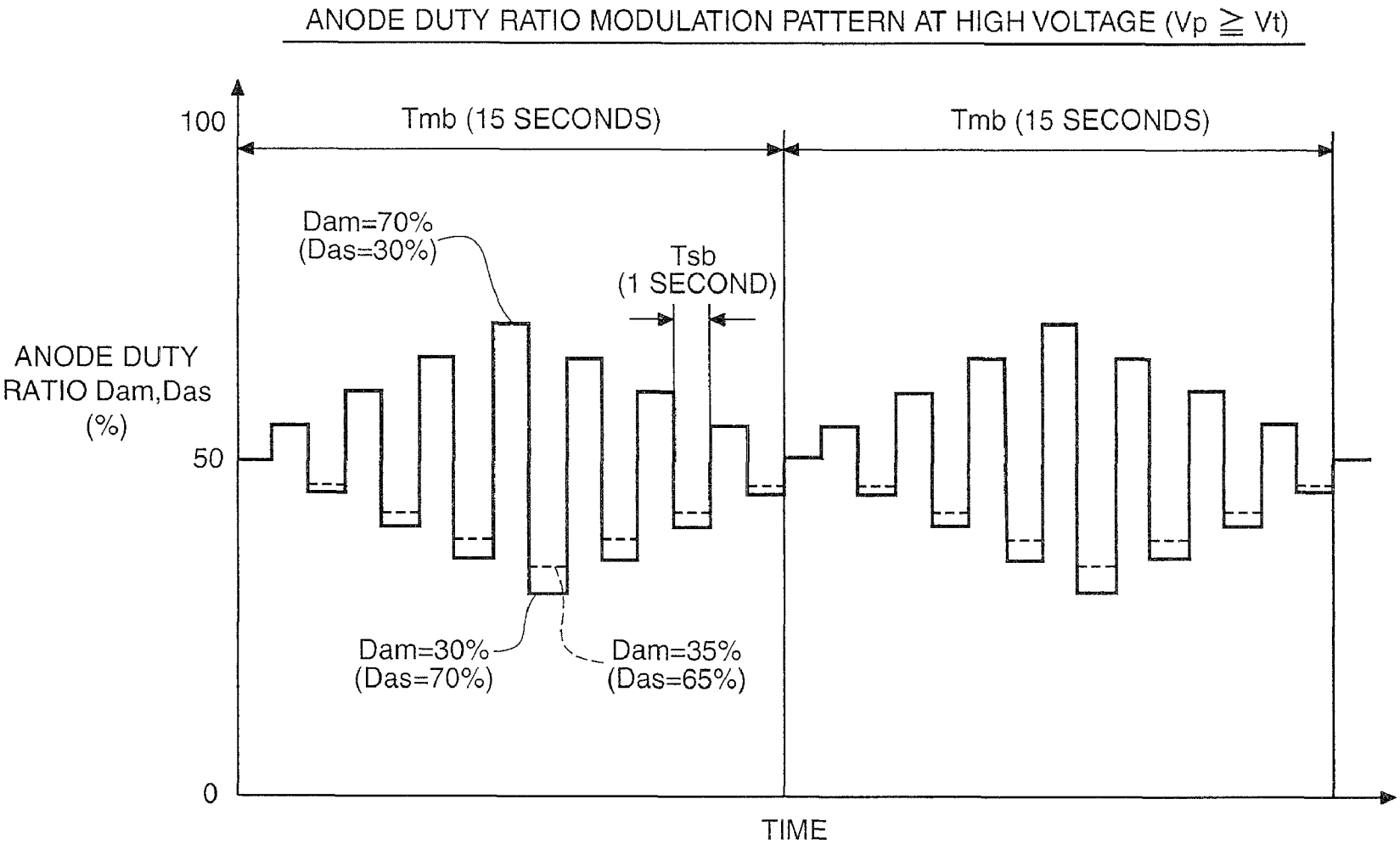
FIG. 8 shows a second modulation pattern of duty ratios at high voltage.

FIG. 8 shows a modulation pattern (second modulation pattern) of duty ratio when the ramp voltage Vp is equal to or higher than the threshold voltage Vt (at high voltage). The graph in FIG. 8 shows changes of the anode duty ratio Dam of the main mirror side electrode 610 with time. According to the second modulation pattern, the condition in which the anode duty ratio Dam is higher than a reference duty ratio (50%) and the condition in which the anode duty ratio Dam is lower than the reference duty ratio are alternately switched every time a step time Tsb (1 second) elapses. The deviation width of the anode duty ratio Dam from the reference duty ratio gradually increases from the start of a modulation cycle Tmb to the intermediate point for 15 seconds, and gradually decreases from the intermediate point to the end point of the modulation cycle Tmb. The reference duty ratio can be varied according to the characteristics and power supply condition of the electric discharge lamp 500. At high voltage, the ramp current Ip is set based on the established anode duty ratio Dam in the same manner as in case of low voltage (FIG. 7B). Thus, the explanation of the changes of the ramp current Ip with time is not repeated.

According to the second modulation pattern shown in FIG. 8, the condition in which the anode duty ratio Dam is higher than the reference duty ratio (50%) and the condition in which the anode duty ratio Dam is lower than the reference duty ratio are alternately switched. Thus, the change of the anode duty ratio Dam varying in a stepped manner (hereinafter referred to as "step change" as well) is larger than the step change (4%) of the anode duty ratios Dam and Das according to the first modulation pattern shown in FIG. 6. In the first embodiment, the step change at high voltage is larger than the step change at low voltage in the first modulation pattern for the entire period of the modulation cycle Tmb. It is only required, however, the step change at high voltage is larger than the step change at low voltage at least for a part of the period of the modulation cycle Tmb.

According to the first embodiment, such a modulation pattern is used in which the maximums of the anode duty ratios Dam and Das of the main mirror side electrode 610 and the sub mirror side electrode 710 become the same value (70%) as the modulation pattern at high voltage as indicated by the solid line in FIG. 8. However, the maximum of the anode duty ratio Das of the sub mirror side electrode 710 may be set at a value (65%) lower than the maximum (70%) of the anode duty ratio Dam of the main mirror side electrode 610 as indicated by a broken line in FIG. 8. By setting the maximum of the anode duty ratio Das of the sub mirror side electrode 710 at a value lower than the maximum of the anode duty ratio Dam of the main mirror side electrode 610, excessive temperature increase of the sub mirror side electrode 710 can be prevented.

Figure 9A:
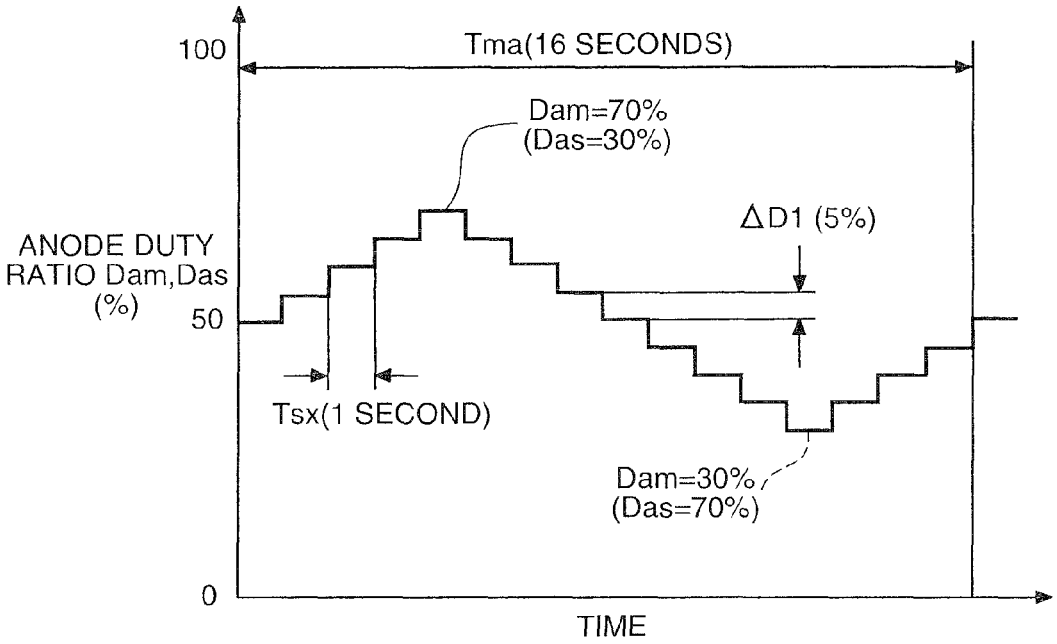
FIGS. 9A and 9B show effect of duty ratio change on a projection of an electrode for each step.
Figure 9B:
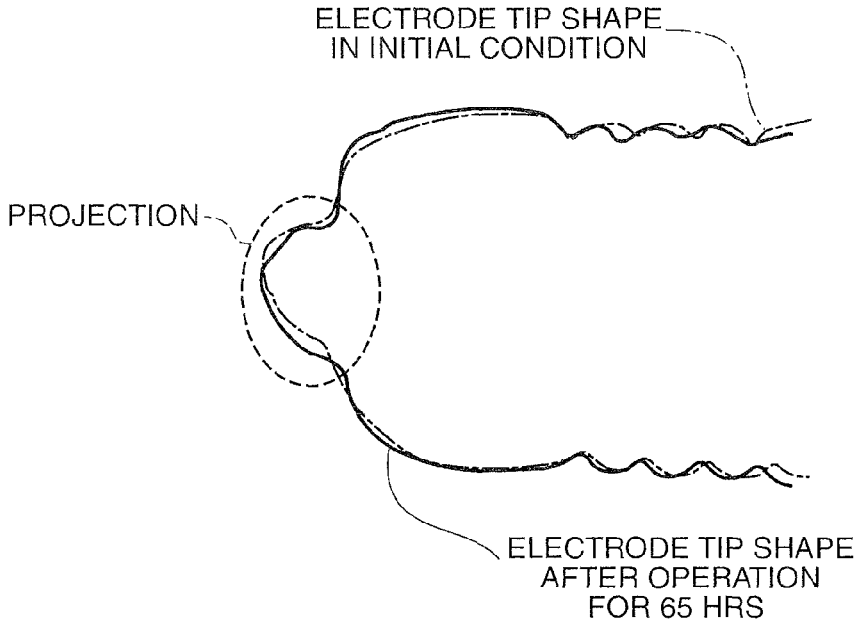
Figure 10A:
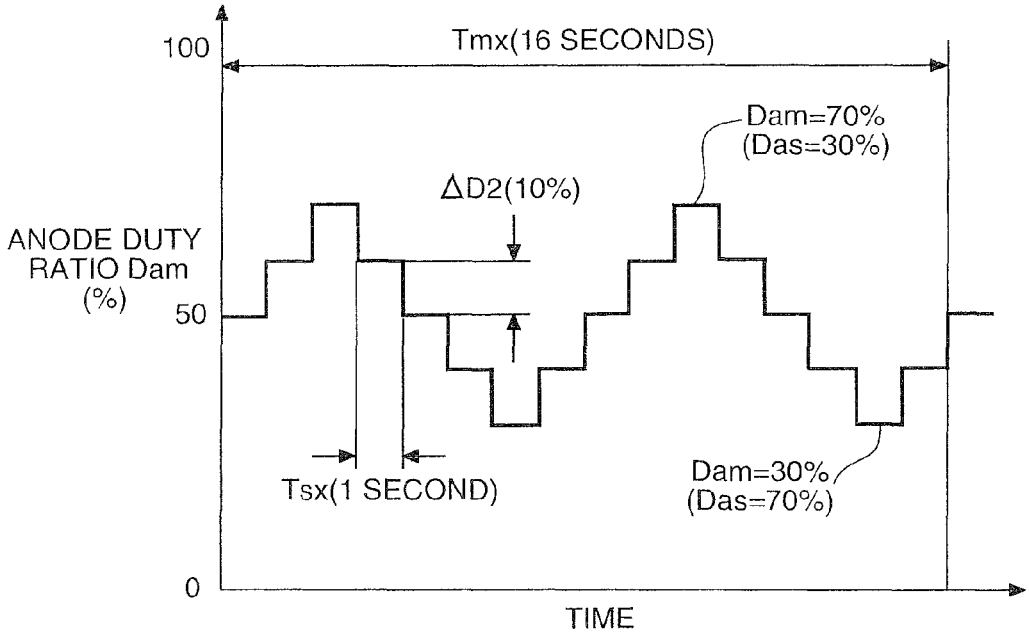
FIGS. 10A and 10B show effect of duty ratio change on the projection of the electrode for each step.
Figure 10B:
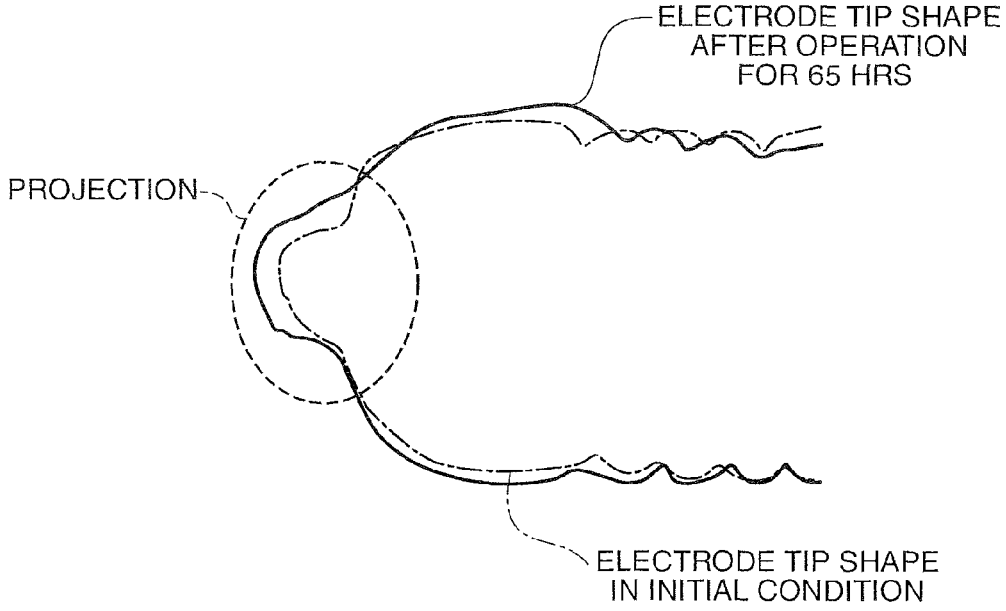
Figure 11A:
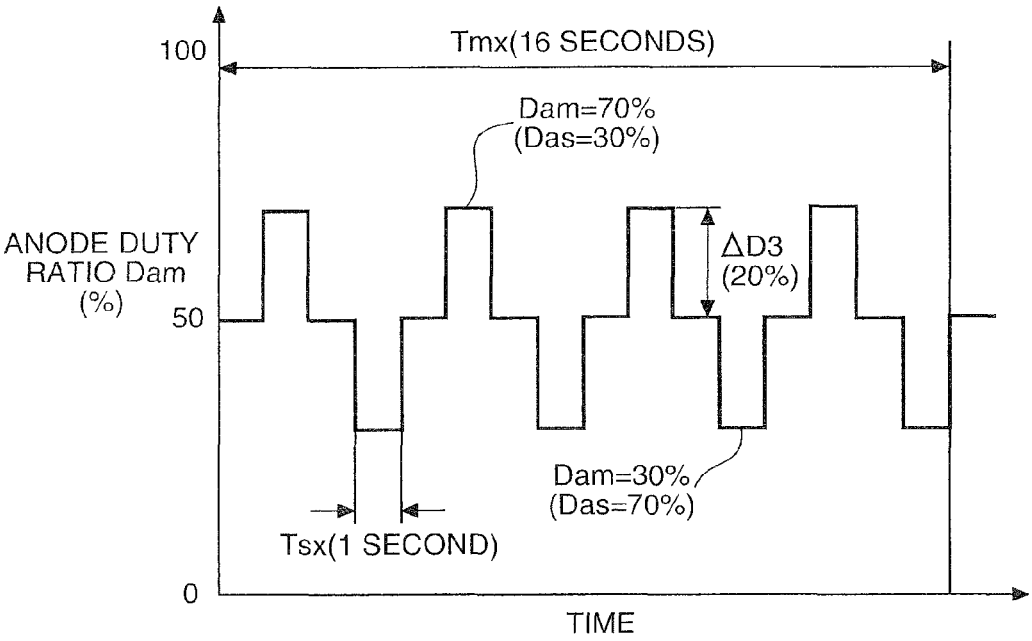
FIGS. 11A and 11B show effect of duty ratio change on the projection of the electrode for each step.
Figure 11B:
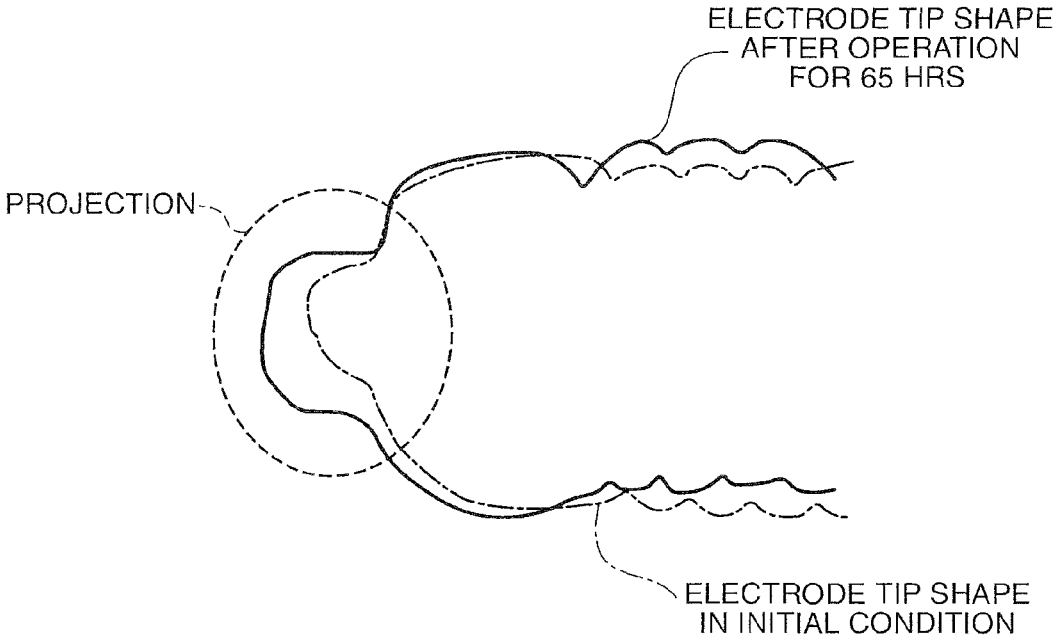

FIGS. 9B through 11B show the effect of the duty ratio change for each step on the projections 618 and 718 of the electrodes 610 and 710. FIGS. 9A, 10A, and 11A show modulation patterns when the step changes are 5%, 10%, and 20%, respectively. The horizontal axis in each graph indicates time, and the vertical axis indicates the anode duty ratio Dam of the main mirror side electrode 610. FIGS. 9B, 10B, and 11B show changes of the electrode tip shape when the modulation patterns in FIGS. 9A, 10A, and 11A are used. A solid line in each of FIGS. 9B, 10B, and 11B shows the electrode tip shape after operating the electric discharge lamp 500 for 65 hours, and an alternate long and short dash line shows the electrode tip shape before the electric discharge lamp 500 is used.

In case of the modulation pattern shown in FIG. 9A, that is, when the step change is 5%, the size of the projection at the electrode tip surrounded by a broken line is approximately the same as that when the electric discharge lamp 500 is not used (alternate long and short dash line) as shown in FIG. 9B. When the step change is 10% (FIG. 10A), the size of the projection at the electrode tip surrounded by a broken line is larger than that when the step change is 5% as shown in FIG. 10B. When the step change is 20% (FIG. 11A), the size of the projection at the electrode tip surrounded by a broken line is still larger than that when the step change is 10%. Thus, the size of the projection at the electrode tip after operating the electrode discharge lamp 500 becomes larger as the step change increases.

According to the first embodiment, therefore, the anode duty ratio Dam is modulated by the first modulation pattern (FIG. 6) providing small step change when the ramp voltage Vp is lower than the predetermined threshold voltage Vt. By using the first modulation pattern providing small step change at low voltage, blacking of the inner wall of the discharge space 512 is prevented. When the ramp voltage Vp is equal to or higher than the threshold voltage Vt, the anode duty ratio Dam is modulated by the second modulation pattern (FIG. 8) providing large step change. By using the second modulation pattern providing large step change at high voltage, growth of the projections is promoted, and increase in ramp voltage Vp is prevented. According to the first embodiment, therefore, the ramp voltage Vp is maintained at lower voltage, and blacking of the inner wall of the discharge space 512 is avoided. Thus, the electric discharge lamp 500 can be used for a longer period.

B. Second Embodiment

Figure 12:
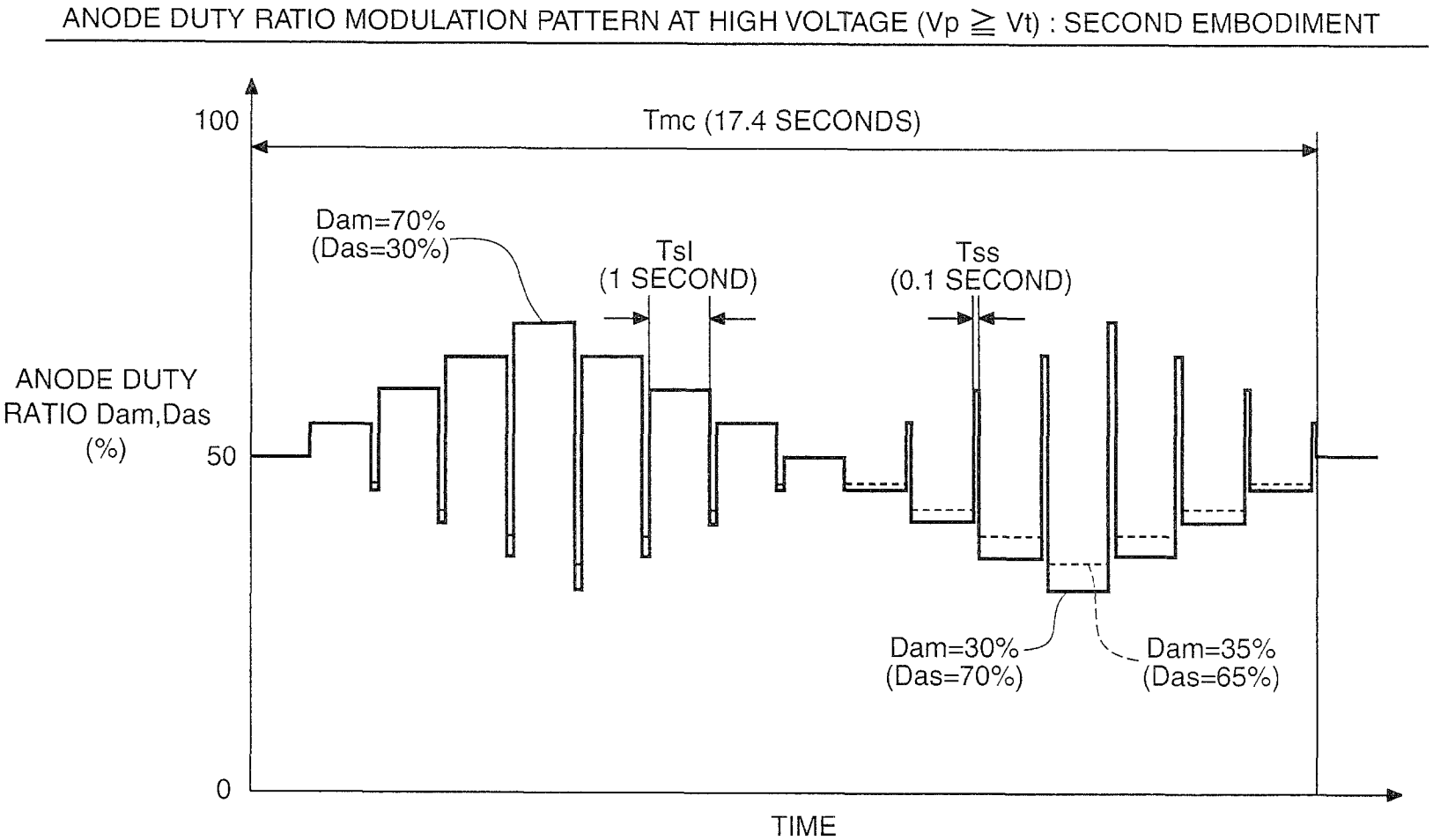
FIG. 12 shows a modulation pattern used when ramp voltage is equal to or higher than threshold voltage according to a second embodiment.

FIG. 12 shows a modulation pattern used when the ramp voltage Vp is equal to or higher than the threshold voltage Vt in a second embodiment. According to the modulation pattern at high voltage in the second embodiment, a period in which the anode duty ratio Dam is lower than the reference duty ratio (50%) (low duty ratio period) is reduced in the first half of the modulation cycle Tmc, and a period in which the anode duty ratio Dam is higher than the reference duty ratio (high duty period) is reduced in the second half of the modulation cycle Tmc. Other points are similar to those in the first embodiment.

While the anode duty ratio of one electrode is high, the temperature of the corresponding electrode increases. When the electrode operates as cathode at the increased temperature, release of electrode material into the discharge space 512 (sputter) caused by collision of cations (such as $Ar^+$ and $Hg^+$) generated by discharge increases. As a result, blacking of the inner wall of the discharge space 512 is easily produced. According to the second embodiment, therefore, generation of sputter from the main mirror side electrode 610 is reduced by decreasing the low duty ratio period in the first half of the modulation cycle Tmc in which the temperature of the main mirror side electrode 610 increases, and generation of sputter from the sub mirror side electrode is reduced by decreasing the high duty ratio period in the second half of the modulation cycle Tmc in which the sub mirror side electrode 710 increases.

Similarly to the first embodiment, step change of the modulation pattern used at high voltage is larger than that of the modulation pattern at low voltage in the second embodiment. Thus, similarly to the first embodiment, growth of the projections is promoted at high voltage, and increase of the ramp voltage Vp is prevented.

Similarly to the first embodiment, the ramp voltage Vp can be maintained at lower voltage, and blacking of the inner wall of the discharge space 512 is prevented in the second embodiment. Thus, the electric discharge lamp 500 can be used for a long period. Blacking of the inner wall of the discharge space 512 can be further prevented by setting the high duty ratio period and the low duty ratio period alternately switched at different lengths in the modulation pattern at high voltage.

Similarly to the first embodiment, the maximum of the anode duty ratio Das of the sub mirror side electrode 710 may be set at a value (65%) lower than the maximum (70%) of the anode duty ratio Dam of the main mirror side electrode 610 as indicated by a broken line in FIG. 12 in the second embodiment. By setting the maximum of the anode duty ratio Das of the sub mirror side electrode 710 at a value lower than the maximum of the anode duty ratio Dam of the main mirror side electrode 610, excessive temperature increase of the sub mirror side electrode 710 can be prevented.

C. Third Embodiment

Figure 13A:
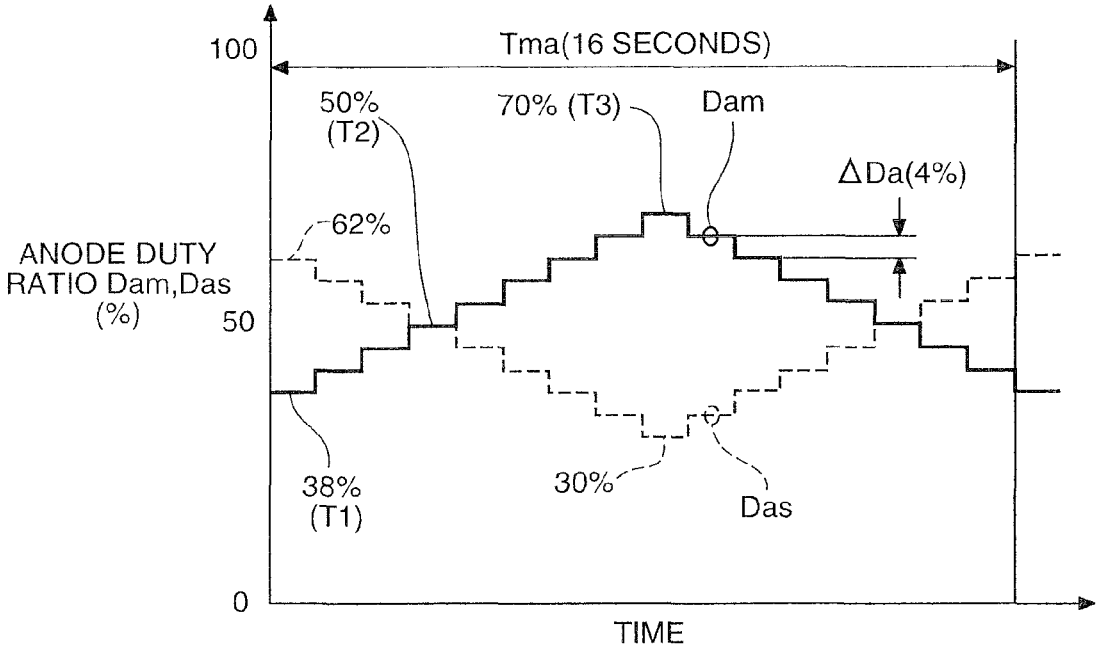
FIGS. 13A and 13B show operation of an electric discharge lamp according to a third embodiment.
Figure 13B:
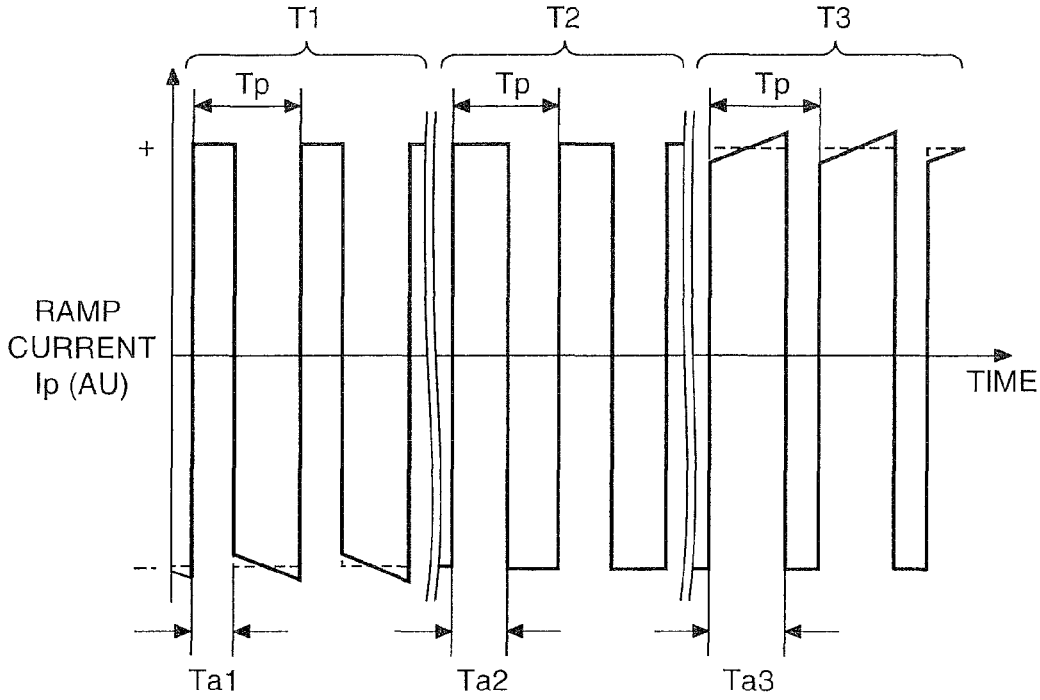

FIGS. 13A and 13B show the operation of the electric discharge lamp 500 according to a third embodiment. FIG. 13A shows a modulation pattern of duty ratios at low voltage. FIG. 13A is the same as FIG. 7A, and the explanation is not repeated herein. Solid lines in FIG. 13B show changes of the ramp current Ip with time for each of the three periods T1 through T3 in the third embodiment, and broken lines show changes of the ramp current Ip with time for each of the three periods T1 through T3 in the first embodiment. The ramp current Ip at high voltage is set based on the established anode duty ratio in the same manner as at low voltage shown in FIG. 13B.

As shown in FIG. 13B, triangular waves are superimposed on the ramp current Ip in the period in which the duty ratio exceeds the reference duty ratio (50%) in the third embodiment. In this case, the absolute value (level) of the ramp current Ip at the last end of the corresponding period is set at a value larger than the average of the ramp current Ip in the corresponding period. When the ramp current Ip at the last end of the period in which the duty ratio exceeds the reference duty is set at a value higher than the average of the ramp current Ip in the corresponding period, fusion of the tip portions of the electrodes 610 and 710 is promoted. As a result, growth of the projections is further promoted.

As discussed above, growth of the projections is promoted when the absolute value of the ramp current Ip at the last end of period in which the duty ratio exceeds the reference duty (50%) is set at a value higher than the average of the ramp current Ip in the corresponding period in the third embodiment. Thus, increase of the ramp voltage Vp can be further prevented. While the absolute value of the ramp current Ip at the last end of the period in which the duty ratio exceeds the reference duty ratio is high at both low voltage and high voltage in the third embodiment, it is possible to increase the absolute value of the ramp current Ip at the last end of the period in which the duty ratio exceeds the reference duty ratio only at high voltage.

D. Modified Example

The invention is not limited to the embodiments described above, but may be practiced otherwise without departing from the scope and spirit of the invention. For example, the following modifications may be made.

D1. Modified Example 1

While deterioration of the electric discharge lamp 500 is detected based on the ramp voltage Vp in the embodiments, deterioration of the electric discharge lamp 500 may be detected by other methods. For example, deterioration of the electric discharge lamp 500 may be detected based on generation of arc jump caused by flatness of the main bodies 616*a* and 716*a* (FIGS. 5B and 5C). In this case, generation of arc jump can be detected by using photo sensor such as photo diode disposed close to the electric discharge lamp 500, for example.

D2. Modified Example 2

While the liquid crystal light valves 330R, 330G, and 330B are used as light modulation units of the projector 1000 (FIG. 1) in the embodiments, the light modulation units may be other modulation units such as DMD (digital micromirror device: trademark of Texas Instruments Inc.). The invention is applicable to various types of image display apparatus such as liquid crystal display apparatus, exposure device, and lighting device which include an electric discharge lamp as light source.

What is claimed is:

1. A driving device of an electric discharge lamp comprising:

a discharge lamp lighting unit which supplies power to the electric discharge lamp while alternately switching a polarity of voltage applied between two electrodes of the electric discharge lamp to light the electric discharge lamp; and an anode duty ratio modulating unit which sets at least a first retention period and a second retention period for modulating anode duty ratios, each of the retention periods being a period for retaining an anode duty ratio as a ratio of an anode period in which one of the electrodes operates as an anode at a constant value in one cycle of the polarity switching, and the second retention period having an anode duty ratio different from that of the first retention period and being provided after the first retention period, the anode duty ratio modulating unit having a first modulation mode and a second modulation mode for providing a larger change of the anode duty ratio between the first retention period and the second retention period than a change of the anode duty ratio for the first modulation mode.

2. The driving device of the electric discharge lamp according to claim 1, the anode duty ratio in the first retention period and the anode duty ratio in the second retention period varying in such a manner as to cross a duty ratio reference value established in advance based on an intermediate value in a modulation range of the anode duty ratios in the second modulation mode.

3. The driving device of the electric discharge lamp according to claim 2, the length of the first retention period and the length of the second retention period being different from each other.

4. The driving device of the electric discharge lamp according to claim 3, the length of the period in which the anode duty ratio is higher than the duty ratio reference value being longer tan the length of the period in which the anode duty period is lower than the duty ratio reference value in a predetermined period of one cycle of the modulation, and the length of the period in which the anode duty ratio is higher than the duty ratio reference value being shorter than the length of the period in which the anode duty period is lower than the duty ratio reference value in the remaining period of one cycle of the modulation.

5. The driving device of the electric discharge lamp according to claim 1, further comprising:

an electrode condition detecting unit which detects deterioration of the electrodes by use of the electric discharge lamp, wherein the anode duty ratio modulating unit performs the second modulation mode when the electrode condition detecting unit detects deterioration of the electrodes.

6. The driving device of the electric discharge lamp according to claim 5, the electrode condition detecting unit detecting the deterioration condition based on voltage generated between the electrodes when predetermined power is supplied to the electric discharge lamp, and the anode duty ratio modulating unit judging that the electrodes are deteriorated when the voltage between the electrodes is equal to or higher than reference voltage.

7. The driving device of the electric discharge lamp according to claim 1, the anode duty ratio modulating unit setting the maximum of the anode duty ratio of the one electrode in the modulation range at a value lower than the maximum of the anode duty ratio of the other electrode in the modulation range when the temperature of one of the two electrodes is higher than the temperature of the other electrode during operation.

8. The driving device of the electric discharge lamp according to claim 7, the electric discharge lamp including a reflection mirror for reflecting light emitted between the electrodes toward the other electrode such that the temperature of the one electrode increases higher than the temperature of the other electrode during operation.

9. The driving device of the electric discharge lamp according to claim 1, the discharge lamp lighting unit setting a current level to be supplied to the two electrodes at the last end of the anode period during which the corresponding one electrode continuously operates as anode at a value higher than the average of current to be supplied during the anode period at the time of the power supply when the anode duty ratio of one of the two electrodes is at least equal to or greater than a predetermined reference value.

10. A light source device comprising:

an electric discharge lamp;

a discharge lamp lighting unit which supplies power to the electric discharge lamp while alternately switching polarity of voltage applied between two electrodes of the electric discharge lamp to light the electric discharge lamp; and an anode duty ratio modulating unit which sets at least a first retention period and a second retention period for modulating anode duty ratios, each of the retention periods being a period for retaining an anode duty ratio as a ratio of an anode period in which one of the electrodes operates as an anode at a constant value in one cycle of the polarity switching, and the second retention period having an anode duty ratio different from that of the first retention period and being provided after the first retention period, the anode duty ratio modulating unit having a first modulation mode for operating the electric discharge lamp in steady condition and a second modulation mode for providing a larger change of the anode duty ratio between the first retention period and the second retention period than a change of the anode duty ratio for the first modulation mode.

11. An image display apparatus, comprising:

an electric discharge lamp as a light source for image display;

a discharge lamp lighting unit which supplies power to the electric discharge lamp while alternately switching polarity of voltage applied between two electrodes of the electric discharge lamp to light the electric discharge lamp; and an anode duty ratio modulating unit which sets at least a first retention period and a second retention period for modulating anode duty ratios, each of the retention periods being a period for retaining an anode duty ratio as a ratio of an anode period in which one of the electrodes operates as an anode at a constant value in one cycle of the polarity switching, and the second retention period having an anode duty ratio different from that of the first retention period and being provided after the first retention period, the anode duty ratio modulating unit having a first modulation mode for operating the electric discharge lamp in steady condition and a second modulation mode for providing a larger change of the anode duty ratio between the first retention period and the second retention period than a change of the anode duty ratio for the first modulation mode.

12. A driving method of an electric discharge lamp, comprising the steps of:

supplying power to the electric discharge lamp while alternately switching polarity of voltage applied between two electrodes of the electric discharge lamp to light the electric discharge lamp;

retaining a first anode duty ratio during a first retention period, the first anode duty ratio being a ratio of an anode period in which one of the electrodes operates as an anode at a constant value in one cycle of the polarity switching;

retaining a second anode duty ratio during a second retention period, the second anode duty ratio being a ratio of an anode period in which the one of the electrodes operates as an anode at a constant value in one cycle of the polarity switching, the second duty ratio being different from the first duty ratio, the second retention period being provided after the first retention period so that the duty ratio is modulated; and changing modulation modes from a first modulation mode to a second modulation mode of which a difference between the first anode duty ratio and the second duty ratio is larger than that of the first modulation mode.

13. A driving device of an electric discharge lamp comprising:

a discharge lamp lighting unit that supplies an AC pulse current to the electric discharge lamp, being configured to switch polarity of a voltage applied between two electrodes of the electric discharge lamp within a switching cycle;

an electrode condition determining unit that determines a parameter indicating a condition of the electrodes; and an AC pulse current modulating unit that modulates a duty cycle of the AC pulse current, so that a first difference between the duty cycle of the AC pulse current from one switching cycle to a subsequent switching cycle when the parameter meets a predetermined criteria is greater than a second difference between the duty cycle of the AC pulse current from one switching cycle to a subsequent switching cycle when the parameter does not meet the predetermined criteria.

14. The driving device of the electric discharge lamp according to claim 13, the electrode condition determining unit determining a voltage generated between the electrodes required to produce a predetermined amount of power as the parameter, and comparing the parameter to a predetermined threshold voltage as the predetermined criteria.

15. The driving device of the electric discharge lamp according to claim 13, the electrode condition determining unit being a photo sensor that determines a brightness of an arc generated from the electric discharge lamp as the parameter, and compares the parameter to a predetermined threshold brightness as the predetermined criteria.

16. The driving device of the electric discharge lamp according to claim 13, the one switching cycle, which has a higher duty cycle than the subsequent switching cycle, being longer in duration than the subsequent switching cycle when the parameter meets the predetermined criteria.

17. The driving device of the electric discharge lamp according to claim 13, the discharge lamp lighting unit setting a current level to be supplied to the electrodes immediately before a polarity switch to a value higher than an average current value supplied to the electrodes from the beginning of the switching cycle to a time of the polarity switch when the duty cycle of the AC pulse current is at least equal to or greater than a predetermined reference value.

18. A light source device comprising:

an electric discharge lamp; and the driving device of the electric discharge lamp according to claim 13.

19. An image display apparatus comprising:

an electric discharge lamp as a light source for image display; and the driving device of the electric discharge lamp according to claim 13.

20. A driving method of an electric discharge lamp, comprising the steps of:

supplying an AC pulse current to an electric discharge lamp, so as to switch polarity of a voltage applied between two electrodes of the electric discharge lamp within a switching cycle;

determining a parameter indicating a condition of the electrodes; and modulating a duty cycle of the AC pulse current, so that when the parameter meets a predetermined criteria, a first difference between the duty cycle of the AC pulse current from one switching cycle to a subsequent switching cycle is greater than a second difference between the duty cycle of the AC pulse current from one switching cycle to a subsequent switching cycle when the parameter does not meet the predetermined criteria.

* * * * *